US006579217B1

(12) United States Patent
Buxton

(10) Patent No.: US 6,579,217 B1
(45) Date of Patent: Jun. 17, 2003

(54) CENTRIFUGE ROTORS INCLUDING DISPLACEMENT CONTROL

(75) Inventor: Adrian Christopher Buxton, Bury St Edmunds (GB)

(73) Assignee: Seward Ltd. (GB)

( * ) Notice: Subject to any disclaimer, the term of this patent is extended or adjusted under 35 U.S.C. 154(b) by 0 days.

(21) Appl. No.: 09/913,335

(22) PCT Filed: Feb. 8, 2000

(86) PCT No.: PCT/GB00/00401

§ 371 (c)(1),
(2), (4) Date: Dec. 31, 2001

(87) PCT Pub. No.: WO00/47328

PCT Pub. Date: Aug. 17, 2000

(30) Foreign Application Priority Data

Feb. 11, 1999 (GB) ..... 9903100
Feb. 11, 1999 (GB) ..... 9903101

(51) Int. Cl.[7] ..... B04B 5/02
(52) U.S. Cl. ..... 494/20; 494/38
(58) Field of Search ..... 494/16, 20, 21, 494/38, 39

(56) References Cited

U.S. PATENT DOCUMENTS

| | | | | |
|---|---|---|---|---|
| 2,604,261 | A | * | 7/1952 | Silverstolpe |
| 3,361,343 | A | * | 1/1968 | Lerner |
| 3,420,437 | A | * | 1/1969 | Blum et al. |
| 3,674,198 | A | * | 7/1972 | Eberle |
| 3,768,819 | A | * | 10/1973 | Burkert |
| 3,819,111 | A | * | 6/1974 | Romanauskas et al. |
| 3,877,634 | A | | 4/1975 | Rohde et al. |
| 3,901,434 | A | * | 8/1975 | Wright |
| 3,951,334 | A | * | 4/1976 | Fleming et al. |
| 4,202,487 | A | | 5/1980 | Edwards |
| 4,221,324 | A | | 9/1980 | Frey |
| 4,360,151 | A | * | 11/1982 | Cowell et al. |
| 4,431,423 | A | * | 2/1984 | Weyant, Jr. |
| 4,434,909 | A | * | 3/1984 | Ott |
| 4,585,434 | A | * | 4/1986 | Cole |
| 4,586,918 | A | * | 5/1986 | Cole |
| 4,764,162 | A | * | 8/1988 | Romanauskas |
| 5,306,021 | A | * | 4/1994 | Morvant |
| 5,456,652 | A | * | 10/1995 | Eberle |
| 5,487,719 | A | * | 1/1996 | Houston et al. |
| 5,641,085 | A | * | 6/1997 | Lonbardo |
| 5,855,545 | A | * | 1/1999 | Kishi et al. |
| 6,286,838 | B1 | * | 9/2001 | Kruger et al. |

FOREIGN PATENT DOCUMENTS

| | | | | |
|---|---|---|---|---|
| DE | 197 20 409 A1 | | 11/1998 | |
| DE | 19807688 A1 | | 3/1999 | |
| EP | 0 047 840 | | 7/1981 | |
| GB | 102783 | * | 10/1941 | ..... 494/20 |
| GB | 1243944 | | 8/1971 | |
| GB | 2233584 A | | 7/1989 | |
| JP | 63-64745 | * | 12/1988 | ..... 494/20 |

* cited by examiner

*Primary Examiner*—Charles E. Cooley
(74) *Attorney, Agent, or Firm*—Jensen & Puntigam P.S.

(57) ABSTRACT

A centrifuge rotor including a sample carrier (1) enclosing within an outer housing (7,8) and being rotatable about a principal axis of rotation of the rotor, the sample carrier (1) having a peripheral zone for holding sample tubes (6) in an orientation parallel to the said axis when at rest and the sample carrier being capable of deflecting to enable sample tubes (6) to swing out under the effect of centrifugal force. The swinging out of the tubes (6) is constrained and controlled by the arrangement of the sample carrier (1) and contact between the tubes (6) and outer housing (7,8).

13 Claims, 2 Drawing Sheets

CENTRIFUGE ROTORS INCLUDING DISPLACEMENT CONTROL

TECHNICAL FIELD

The present invention relates to centrifuge rotors, and more particularly to a means to control the location of sample tubes during use.

BACKGROUND ART

More particularly, this invention relates to centrifuge rotors of the kind described in GB Patent Specification 2 233 584B. The invention is concerned with providing improvements to the device of the said GB Patent which enable higher speeds, and more consistent performance to be achieved. It is also desirable if when using a transparent rotor, performance of the centrifuging of the sample tubes is readily monitored by a strobing means.

One problem with the previously described centrifuge rotor was that the degree to which the sample tubes swung out during rotation was variable, and moreover there was the variability of flexure around the disc carrier which therefore gave inconsistent performance. The present invention aims to solve these problems and to provide a higher speed of operation.

Another problem with the previously described centrifuge rotor was the effectiveness of the seal.

DISCLOSURE OF THE INVENTION

According to a first aspect of the present invention there is provided a centrifuge rotor including a sample carrier enclosed within an outer housing and being rotatable about a principal axis of rotation of the rotor, the sample carrier having a peripheral zone for holding sample tubes in an orientation parallel to the said axis when at rest and the sample carrier being capable of deflecting to enable sample tubes to swing out under the effect of centrifugal force, wherein the sample carrier incorporates petal-like carriers for each tube equally spaced around said sample carrier, and characterized in that the central region of the sample carrier is of a thicker material than that of material forming said petal-like carriers, so that any flexing is concentrated in the region of said petal-like characters.

According to a second aspect of the present invention, there is provided a centrifuge rotor which comprises a sample carrier rotatable about a principal axis of rotation of the rotor, the sample carrier having a peripheral zone for holding sample tubes to permit centrifuging, and an outer casing having two parts and enclosing the sample carrier, the two parts of the outer casing being sealed together at a peripheral zone by sealing means which is arranged so that sealing is increased by the effect of the centrifugal force arising during centrifuging.

Preferably, the sealing means is a sealing ring having a profile in the form of a V-shape whose vertex is directed outwards. The limbs of the V then flex outwards during the centrifugal force and seal to the two parts in an effective manner.

According to another aspect of the present invention there is provided a centrifuge rotor, including a sample carrier enclosed within an outer casing and being rotatable about a principal axis of rotation of the rotor, the sample carrier having a peripheral zone for holding sample tubes in an orientation parallel to the said axis when at rest, and the sample carrier being capable of deflecting to enable sample tubes to swing out under the effect of centrifugal force, said centrifuge rotor being arranged so that beyond a given speed of rotation of the sample carrier, deflection of the tubes is constrained to a predetermined angle.

In practice, for example, a rotor may have an operational speed in the region of about 12,000 rpm and the deflection would be constrained at speeds above about 6 to 6,500 rpm. Thus, from start up the tubes progressively swing out and become constrained from about half operational speed and upwards as the rotor builds up in speed to its operational level.

Suitably the predetermined angle to which the tubes are constrained may be in the region of 40° to 45°. Constraint may be achieved by arranging for the tube to deflect to a point where it touches and is thereby constrained by the outer casing of the centrifuge; or an alternative means of achieving this constraint is by use of a sample carrier having a peripheral end region which constrains movement of the sample tubes.

Thus, conveniently the centrifuge rotor is enclosed within a transparent outer casing and strobing means can be provided for examination of samples when being centrifuged.

It is preferable for the sample carrier to incorporate apertured, petal-like carriers for each tube equally spaced around said sample carrier and integrally connected to a central region of the carrier which is of a thicker material than that of material forming said petal-like carriers, so that any flexing of the sample carrier during centrifuging is concentrated in the region of said petal-like carriers. This arrangement enables the petal-carriers to each flex independently to a controlled angle without significantly affecting the rest of the carrier. Each petal-like carrier can be joined to the central region of the carrier along a line of weakness which enables each petal-carrier to flex about said line of weakness as the tube swings outwards under the effect of the centrifugal force.

The term petal-like carrier is used here to refer to a carrier of thin material which behaves like a petal or leaf opening out and closing relative to the central region.

Preferably the centrifuge rotor should be enclosed within an outer casing which can be opened and which when closed and during the rotation of centrifuging maintains an effective seal.

Thus the centrifuge rotor may include an outer casing of essentially two parts enclosing the sample carrier, the two-part outer casing being sealed together at a peripheral zone by sealing means which is arranged so that sealing is increased by the effect of the centrifugal force arising during centrifuging.

Preferably the sealing means is a sealing ring having a profile in the form of a V-shape whose vertex is directed outwards. The limbs of the V then flex outwards during the centrifugal force and seal to the two parts in an effective manner.

An embodiment of the invention will now be described by way of example with reference to the accompanying diagrammatic drawings in which:

BEST MODE FOR CARRYING OUT THE INVENTION

Figure 1:
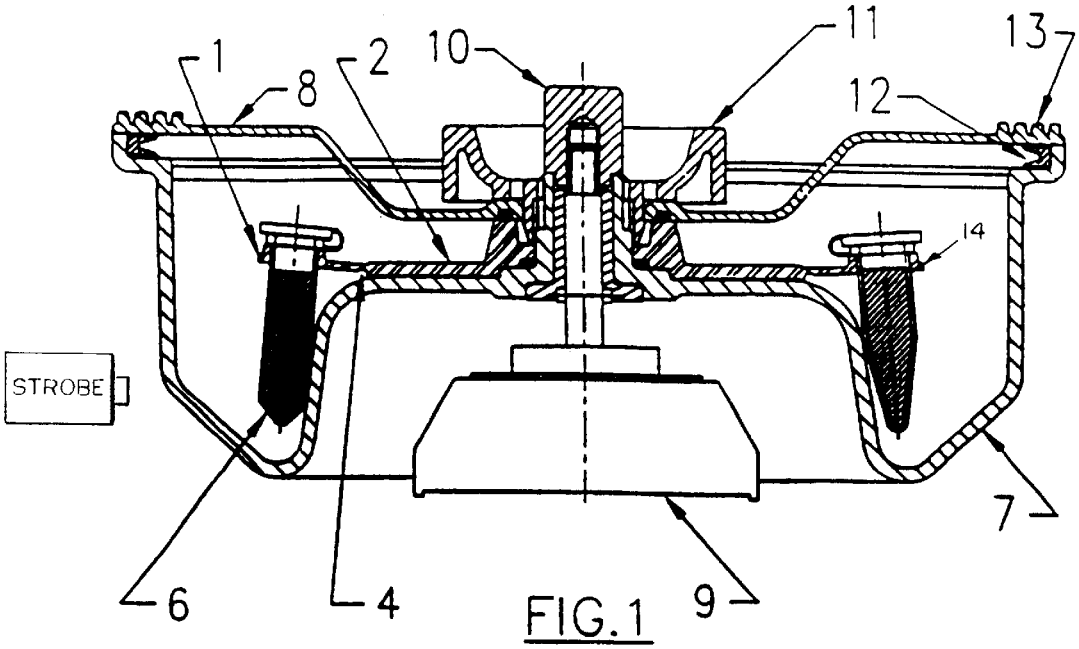
FIG. 1 is a sectioned side view of a centrifuge.
Figure 3:
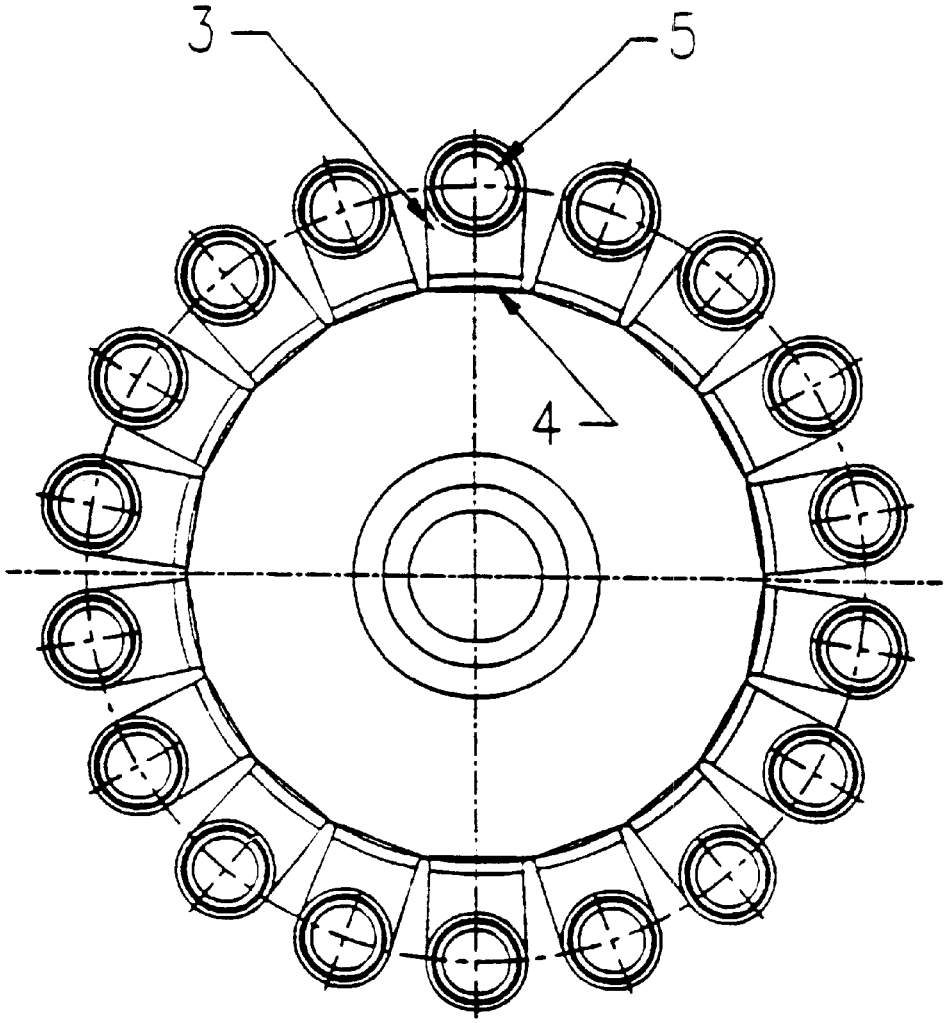
FIG. 3 is a plan view of a sample carrier.

Referring to FIG. 1, a sample carrier essentially in the form of a disc includes a central region 2 of a stiff plastics material having a plurality of petal-like carriers 3 (FIG. 3). The petal-like carriers are each of a thinner material than the central region 2 and are joined to the central carrier at a line of weakness 4. It should be noted that this line of weakness is an optional feature and in some embodiments there is no specific line of weakness.

Each petal-like carrier 3 includes an aperture 5 to accommodate the neck of a sample tube 6. The sample carrier 1 includes thickened collars 14 of material around each of the tube receiving apertures 5. The disc carrier is enclosed within an outer casing in the form of a housing which consists of two parts 7 and 8. The housing parts 7 and 8 and each sample tube are of transparent material so that the samples are visible when in use and when centrifuging is taking place.

The disc carrier rests on a surface of the housing 7, thereby providing greater stiffness and stability to the central region of the sample carrier 2 and the whole sample carrier and housing is carried on a shaft of a motor 9. The lower section 7 of the housing, and the sample carrier 1 are each attached to the shaft of the motor 9 by a nut 10 while the lid section 8 of the housing is attached by a nut 11 which is concentric with and surround the nut 10. Thus, the whole unit can be detached from the motor while retaining the carrier and housing components locked together, or just the lid section 8 can be removed as desired.

The lid section 8 is connected to the lower section 7 at a peripheral region which includes a V-shaped sealing gasket 12. The V-section 12 thus increases its sealing effectiveness while the system is in rotation due to centrifugal forces forcing the limbs of the V to splay outwards against the housing components, thereby providing an effective seal. The V-shape of the gasket 12 also helps to ensure that the seal is not extruded out through the interface between the lid and lower sections 7, 8 during high speed rotation. In operation, as the V-shape gasket 12 tends to open up, the upper and lower limbs of the V press against the corresponding adjacent flat surfaces of the lid and lower sections 7, 8. The underside of the lid section 8 in the region of gasket 12 and from the gasket 12 to the lid's periphery is substantially flat. A recess housing the gasket 12 is provided entirely by an upstanding flange on the lower section 7. This means that the gasket 12 can be conveniently and neatly sealed on the lower section 7. The upper section, that is the lid section 8, includes reinforcing circumferential ribs 13 to ensure that distortion does not arise at the point of seal during high speed rotation.

Figure 2:
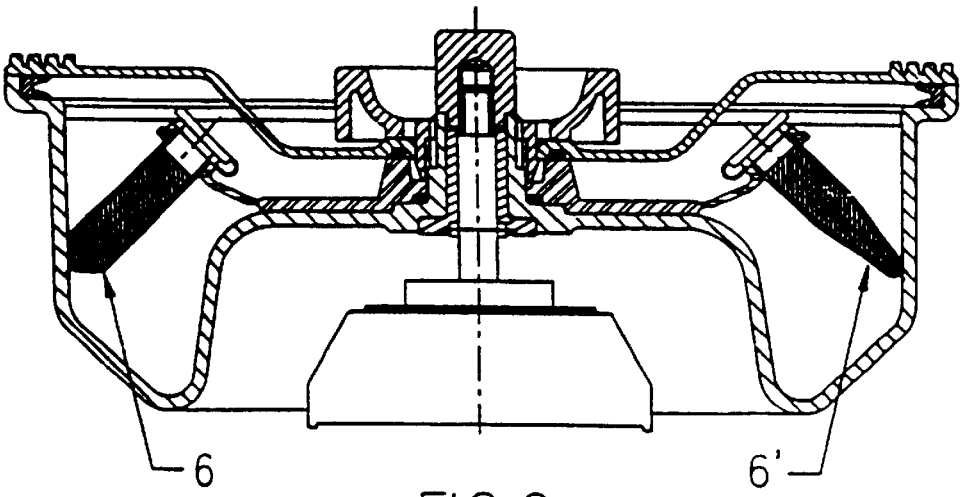
FIG. 2 is a view of the centrifuge in use.

FIG. 2 shows a sectional view of the centrifuge in use, and it can be seen that the sample tube 6 has splayed outwards to an angle of substantially 45° due to the centrifugal forces arising, and the petal-like carrier has hinged about the line of weakness 4. The dimensions are selected so that the sample tube can only flex to this 45° position where its lower end abuts the edge of the housing 7.

In practice at start up the sample tubes progressively move outwards as the speed builds up and they reach a constrained condition at about half operational speed, and remain in that condition as the speed increases further. Thus in the specific example the operational speed is 11,750 rpm, and the tubes reach their constrained condition at around 6–6,500 rpm.

The fact that the petals 3 are of thinner material and the provision of line of weakness in the sample 1 are important because they limit deformation of the material surrounding the tube receiving apertures 5 in use. Without these features the apertures 5, which are circular at rest, would tend to an oval shape in use. Such deformation would typically cause the inserted tubes 6 to be damaged and/or the petals 3 to rip and the tubes 6 to fall out.

The structure of the sample carrier and in particular the petals and any plastic hinge formed by a line of weakness have to be strong enough to withstand the "swinging out" which occurs in use.

It will be noted that in the fully swung out position, each of the tube ends directly contacts with the internal surface of the outer casing 7. The high loads generated on the sample/tubes 6 during high speed rotation are shared between the structure of the sample carrier 1 itself and the outer casing 7 by virtue of the contact between it and the tube ends. The overall design avoids the provision of tube carriers of the type which substantially surround and provide support for the tubes 6. This minimizes the number of components and allows alternatives where the whole of the sample carrier 1, including the tubes 6 is molded in one piece.

The left hand side of the figure shows a sample tube 6 of one capacity while 6' on the right hand side of the figure shows a sample tube of a slightly lower capacity which is so shaped that it also abuts the wall at the same 45° angle.

In use the centrifuge allows the sample tubes to be rotated at high speed with a controlled orientation so that when viewed by a strobe light, a stable image is shown and the centrifuging operation within the sample tube is visible.

What is claimed is:

1. A centrifuge rotor including a sample carrier enclosed within an outer housing and being rotatable about a principal axis of rotation of the rotor, the sample carrier having a peripheral zone for holding sample tubes in an orientation parallel to said axis when at rest and the sample carrier being capable of deflecting to enable sample tubes to swing out under the effect of centrifugal force, wherein the sample carrier incorporates petal-like carriers for each tube equally spaced around said sample carrier, and characterized in that the central region of the sample carrier is of a thicker material than that of material forming said petal-like carriers, so that any flexing is concentrated in the region of said petal-like carriers.

2. A centrifuge rotor according to claim 1, each petal-like carrier being joined to the central region of the sample carrier along a line of weakness which enables the petal carrier to flex about said line of weakness as the tube swings outwards under the effect of centrifugal force.

3. A centrifuge rotor according to claim 1, which is arranged so that beyond a given speed of rotation of the sample carrier, deflection of the tubes is constrained to a predetermined angle.

4. A centrifuge rotor according to claim 3, in which deflection of the tubes is constrained by direct contact between the tubes and an internal surface of the outer housing.

5. A centrifuge rotor according to claim 1, in which said outer housing is an enclosure in two parts enclosing said sample carrier, said two-part enclosure being sealed together at a peripheral zone by a seal which is arranged so that sealing is increased by the effect of the centrifugal force arising during centrifuging, said seal being a sealing ring having a profile in the form of a V-shape whose vertex is directed outwards.

6. A centrifuge rotor according to claim 1, in which the housing is transparent to enable its contents to be viewed in use.

7. A centrifuge rotor according to claim 6, in which strobing means are provided for examination of samples when being centrifuged.

8. A centrifuge rotor according to claim 1, in which the sample carrier is a one-piece moulding including sample tubes.

9. A centrifuge rotor according to claim 1, in which collars are provided on the sample carrier to surround and support the sample tubes.

10. A centrifuge rotor sample carrier, the sample carrier having a peripheral zone for holding sample tubes in an orientation parallel to the rotation axis of the rotor when at rest and the sample carrier being capable of deflecting to enable sample tubes to swing out under the effect of centrifugal force, wherein the sample carrier incorporates petal-like carriers for each tube equally spaced around said sample carrier, wherein the central region of the sample carrier is of a thicker material than that of material forming said petal-like carriers, so that any flexing is concentrated in the region of said petal-like carriers.

11. A centrifuge rotor sample carrier according to claim 10 wherein each petal-like carrier is joined to the central region of the sample carrier along a line of weakness which enables the petal-like carrier to flex about said line of weakness as the tube swings outwards under the effect of centrifugal force.

12. A centrifuge rotor sample carrier according to claim 10 in which the sample carrier is a one piece molding including sample tubes.

13. A centrifuge rotor sample carrier according to claim 10 in which collars are provided on the sample carrier to surround and support the sample tubes.

* * * * *